US005588390A

United States Patent [19]

French

[11] Patent Number: 5,588,390

[45] Date of Patent: Dec. 31, 1996

[54] UNIVERSAL CAVITATION PLATE SYSTEM

[76] Inventor: Leon D. French, Rte. 3, Box 87-L, Los Fresnos, Tex. 78566

[21] Appl. No.: 557,476

[22] Filed: Dec. 22, 1995

[51] Int. Cl.[6] ..... B63B 1/24

[52] U.S. Cl. ..... 114/274; 440/900

[58] Field of Search ..... 440/900, 66, 76, 440/67, 68, 69, 70, 71, 72, 73; 114/274, 282, 280; D12/309, 317; D15/4

[56] References Cited

U.S. PATENT DOCUMENTS

| | | | |
|---|---|---|---|
| 904,313 | 11/1908 | Davis | 440/66 |
| 1,226,400 | 5/1917 | Smith | 440/66 X |
| 2,111,325 | 6/1935 | Linthwaite | 440/66 |
| 2,747,819 | 5/1956 | Aldrich et al. | 440/900 |
| 2,791,196 | 5/1957 | Strang | 440/65 |
| 2,860,594 | 11/1958 | Kiekhaefer | 440/66 |
| 2,963,000 | 12/1960 | Fester | 440/71 |
| 3,433,195 | 3/1969 | Poole | 114/274 |
| 3,469,557 | 9/1969 | Wollard | 440/69 |
| 3,768,432 | 10/1973 | Spaulding | 440/66 |
| 3,931,828 | 1/1976 | Lawler | 440/88 X |
| 4,070,983 | 1/1978 | Randall | 115/17 |
| 4,205,618 | 6/1980 | Olsson | 440/66 X |
| 4,235,183 | 11/1980 | Evinrude | 440/71 |
| 4,323,355 | 4/1982 | Kondo | 440/76 |
| 4,445,452 | 5/1984 | Loch | 114/282 |
| 4,487,152 | 12/1984 | Larson | 114/274 |
| 4,744,779 | 5/1988 | Koehler | 440/900 |
| 5,138,966 | 8/1992 | Whitley, II | 114/274 |
| 5,178,089 | 1/1993 | Hodel | 114/274 |

*Primary Examiner*—Edwin L. Swinehart
*Attorney, Agent, or Firm*—David L. Mossman

[57] ABSTRACT

A universal cavitation plate system for providing an after-market cavitation plate on the lower unit of virtually all boat motors having lower units and propellers. Each universal cavitation plate assembly has a cavitation plate with a longitudinal slot for receiving the lower unit of the boat motor, an elastomeric insert for cushioning or shock absorption between the lower unit and the cavitation plate, and a filler piece for at least partially filling the exposed space of the longitudinal slot between the rear of the boat and the trailing edge of the cavitation plate.

12 Claims, 2 Drawing Sheets

UNIVERSAL CAVITATION PLATE SYSTEM

FIELD OF THE INVENTION

The invention relates to plates for inhibiting cavitation behind fishing boats, and further relates to, in one embodiment, methods and apparatuses for providing cavitation suppression plates that will fit a variety of lower unit designs of boat engines.

BACKGROUND OF THE INVENTION

It is well known that motor boats which are driven by engines equipped with propellers, whether the engine is of the outboard motor variety or the inboard/outboard type, create a wake behind the boat due to the interaction of the propeller with the surrounding water and air. Although industrial concerns about cavitation relate to the intense vibrations which can cause severe mechanical damage to the surfaces of metals exposed to it, particularly the erosive effect of shock waves created by collapse of bubbles, sportsmen are concerned about the negative effects of excessive turbulence on successful fishing.

There have been numerous devices developed for dampening or reducing cavitation around boat propellers. Many relate to after market additions to the lower units of the engines which ride at or near the interface of the air and the water. Some boat engine manufacturers now provide lower units with small anticavitation plates integrally built into the engine. Sometimes there are separate trim tabs for stabilization of the lower unit, where the trim tabs may be positioned lower for submersion while the anticavitation plate is positioned higher. However, the manufacturer-provided anticavitation plates are often seen as too small to cover enough water surface area to do an adequate job and are frequently supplemented with an after-market extension or expansion of the plate.

Unfortunately, with the proliferation of various engine designs, no one single cavitation plate attachment fits all lower units. As a consequence boating and fishing stores must carry inventory of a number of different cavitation plate designs to meet customers' needs. Since suitable cavitation plates tend to be rather sizable, e.g. from about 2 to about 3 feet wide and from about 3 to about 5 feet long, they are not convenient to store and occupy considerable space. It would be desirable and advantageous if a way were discovered to provide a cavitation plate that would fit many, if not all, of the lower unit engine designs currently in use.

SUMMARY OF THE INVENTION

Accordingly, it is an object of the present invention to provide a "universal" cavitation plate system which provides one cavitation plate structure that will fit a plurality of lower unit boat engine designs.

It is another object of the present invention to provide a universal cavitation plate assembly that may be easily installed and removed by a consumer with conventional tools.

It is yet another object of the invention to provide a cavitation plate assembly which will minimize and dampen cavitation and turbulence around the propeller of a boat engine lower unit.

In carrying out these and other objects of the invention, there is provided, in one form, a universal cavitation plate assembly having a cavitation plate with a leading edge, a trailing edge on the opposite side of the cavitation plate from the leading edge, and a longitudinal slot opening in the trailing edge and extending toward the leading edge for part of a length of the cavitation plate. The slot has a forward portion toward the leading edge; this forward portion may be curved. The longitudinal slot receives and is connected to a lower unit of a boat engine. The assembly also includes an elastomeric insert adapted to fit in the longitudinal slot of the cavitation plate at the forward portion between the forward portion and the lower unit. Finally, the assembly also has a filler piece to occupy space remaining in the longitudinal slot between the lower unit and the trailing edge.

It will be appreciated that the drawings may not be necessarily to scale, and that certain features may be exaggerated in proportion to other feature for emphasis.

DETAILED DESCRIPTION OF THE INVENTION

The invention concerns a universal cavitation plate assembly that will minimize and suppress cavitation and turbulence of water over the propeller of the lower unit of a boat engine, and which may be fitted to virtually any lower unit design. As will be explained, the cavitation plate assembly consists of three parts: a cavitation plate itself, an elastomeric insert and a filler piece. The cavitation plate is designed to fit around any lower unit via a longitudinal slot. The elastomeric insert fits around the lower unit, between the lower unit and the slot to "seal" the space and serve as a shock absorber between the two. The filler piece covers and fills any portion of the longitudinal slot not occupied by the lower unit and the elastomeric insert.

In one embodiment, it is anticipated that the dealer will only have to carry and stock one kind of cavitation plate, one elastomeric insert and either (i) from five to eight filler pieces of various dimensions, or (ii) one single filler piece that can be readily modified by the dealer, to accommodate the various lower unit designs. This universal cavitation plate system will greatly reduce the amount of inventory the dealer will have to maintain. In addition, the storage space required by this inventory would be greatly reduced.

Figure 1:
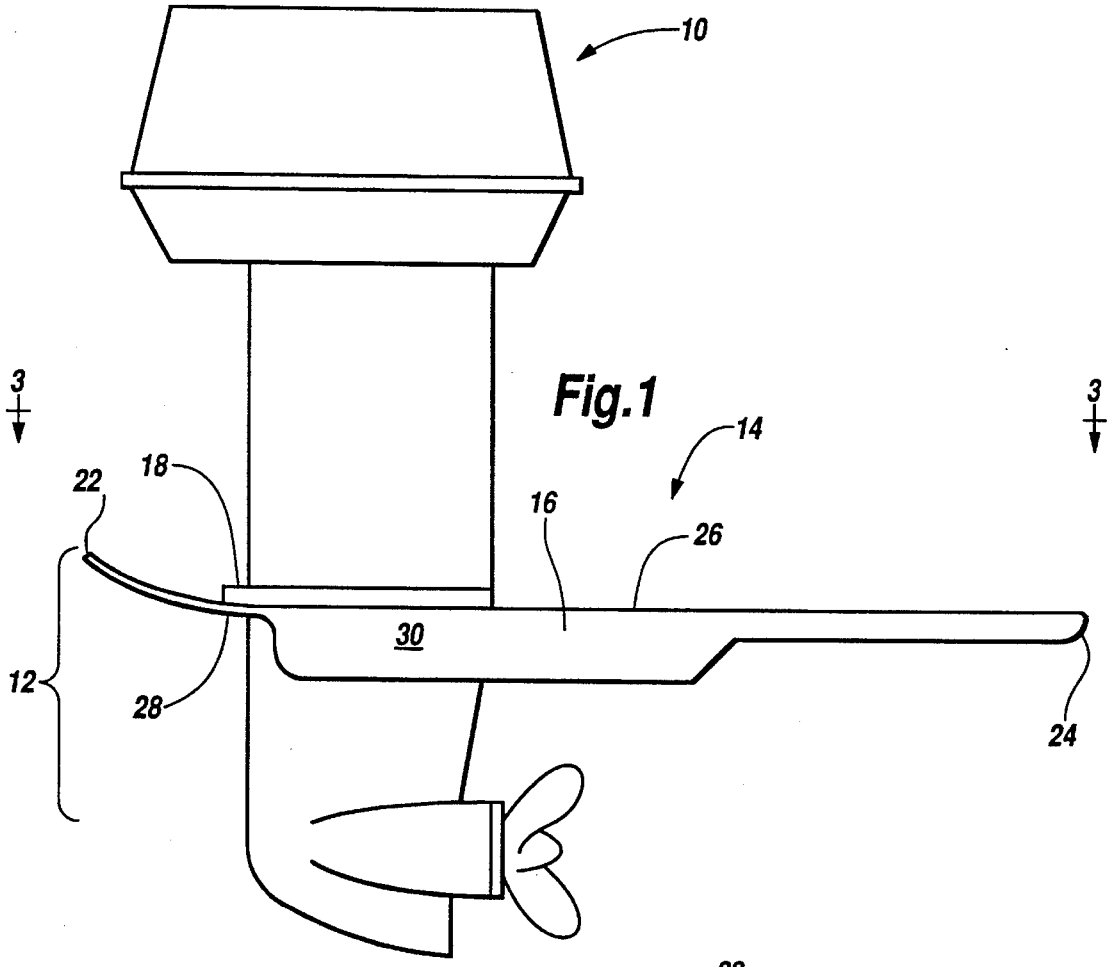
FIG. 1 is a side, elevation view of an outboard motor having its lower unit fitted with a universal cavitation plate assembly in one embodiment of this invention.

Referring more specifically to FIG. 1, an outboard boat motor 10 is shown having a lower unit 12 which possess lateral integral trim tabs or a lateral integral anticavitation plate (not shown in this view; please see FIG. 4) around which the universal cavitation plate assembly, generally referred to as 14, is affixed. The universal cavitation plate assembly 14 has a cavitation plate 16 and an elastomeric filler 18 secured in place by a snug fit of the components. An advantage of the invention is that no special securing mechanisms (such as bolts, screws, etc.) are required to assemble the cavitation plate and elastomeric filler 18 around the lower unit 12, although such additional securing mechanisms could be used, if desired.

It will be appreciated that while plate 16 is termed a "cavitation" plate because this is the conventional name in the industry, it will be understood that its function is not to cause cavitation, but rather to reduce or suppress it. That is, it would be more accurate in one sense to call plate 16 an anticavitation plate, and this name is sometimes used, but the term "cavitation plate" is also conventional and seems more common.

Figure 2:
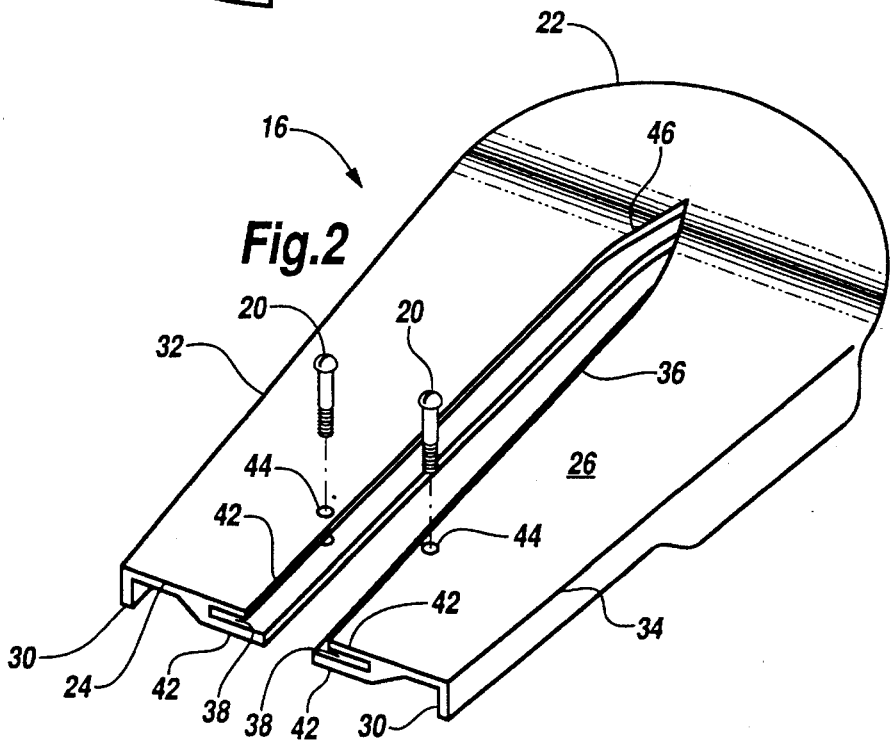
FIG. 2 is a three-quarters, perspective view of one embodiment of the cavitation plate that is a primary and standard component of the universal cavitation plate assembly of this invention.
Figure 3:
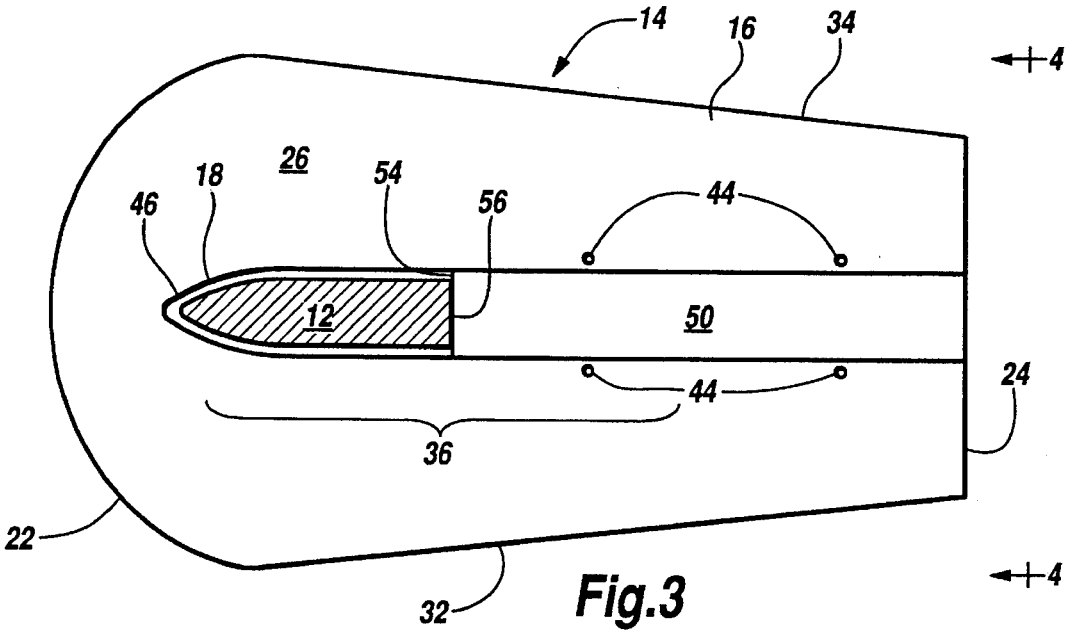
FIG. 3 is a plan, top, partial sectional view of the universal cavitation plate assembly of FIG. 1 taken along line 3—3.

Cavitation plate 16 is provided with a leading edge 22 and a trailing edge 24. Optionally, leading edge 22 may optionally have a curved convex contour as shown in FIGS. 2 and 3, and may also optionally be curved upward from the plane of the top surface 26 of cavitation plate 16 to permit plate 16 to plane along the water more readily. Top surface 26 is opposite bottom surface 28; bottom surface 28 contacts the water surface. Cavitation plate 16 may optionally be provided with stabilizing fins 30 on both the left side 32 and right side 34 of cavitation plate 16. Stabilizing fins 30 may also be seen in FIGS. 2 and 4.

Cavitation plate 16 is provided with a longitudinal slot 36 as shown in FIG. 2 which opens at the trailing edge 24 and extends toward the leading edge 22 for part, but not all, of the length of cavitation plate 16. That is, longitudinal slot 36 does not extend the entire length of the cavitation plate 16 to also open at leading edge 22, but stops some distance back therefrom. In one embodiment of the invention, longitudinal slot 36 extends approximately ⅞ to ⅘ the length of the cavitation plate 16, but this proportion range is exemplary only and is not a critical feature of the invention. Longitudinal slot 36 has a generally V-shaped forward portion 46 thereof which is the part of slot 36 closest to leading edge 22. Forward portion 46 may be slightly rounded at its most forward terminus or more completely curved, which may give it a more U-shaped appearance.

Figure 4:
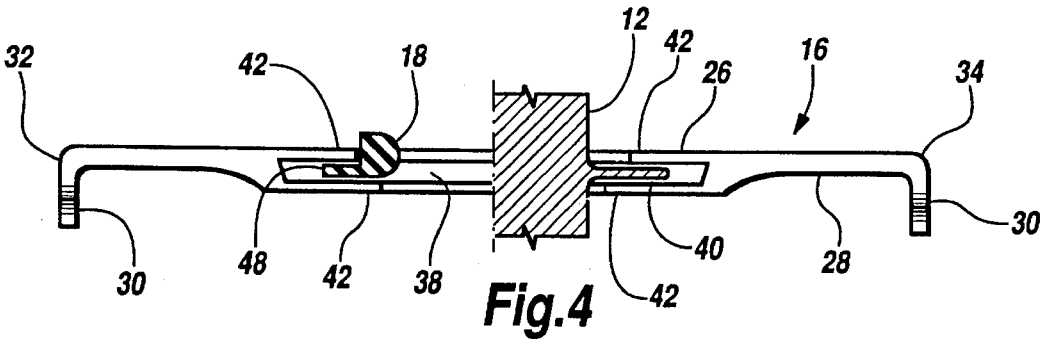
FIG. 4 is an end view of the cavitation plate and partial, sectional end view of the elastomeric insert and lower unit taken along line 4—4 of FIG. 3.
Figure 5:
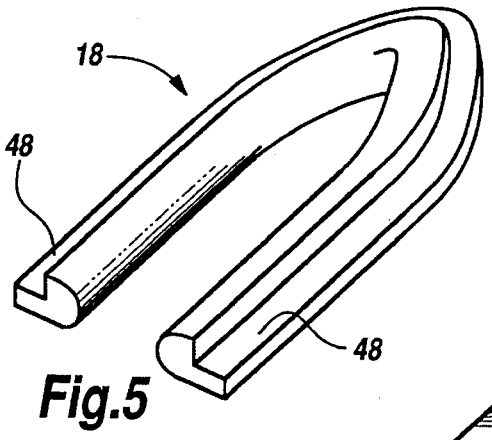
FIG. 5 is a three-quarters, perspective view of the elastomeric insert, another standard component of the universal cavitation plate assembly of this invention.

Longitudinal slot 36 in turn may be provided with lateral grooves 38 on either side thereof to receive the trim tab or integral anticavitation plate 40 and mate therewith, as shown in one embodiment in FIG. 4. Lateral grooves 38 may be flanked on either side by ledges 42, which may be of dissimilar widths, as shown in FIGS. 2 and 4, or may be of the same width (not shown). Lateral grooves 38 may be designed deeply enough, and outer tongues 48 on the elastomeric insert 18 (please see FIG. 5) may be designed widely enough to permit elastomeric insert 18 to close around all lower unit 12 designs. Because of the forward motion of the boat as propelled by the motor 10, lower unit 12 will generally be forced forward against elastomeric insert 18, which, in turn, is forced into the forward portion 46 of longitudinal slot 36. This force will form a tight fit between lower unit 12, elastomeric insert 18 and longitudinal slot 36 of cavitation plate 16. Thus, another advantage of the invention is that it does not require after market modification of the lower unit. As noted, while other fastening mechanisms such as bolts, screws, rivets, etc. could be used to secure cavitation plate 16 and elastomeric insert 18 onto lower unit 12, such additional mechanisms are not preferred since they would complicate the overall universal cavitation plate assembly 14 and increase its cost. Having no requirement for a securing mechanism also increases the ease with which cavitation plate 16 may be removed.

Cavitation plate 16 may be made out of any suitable durable material as long as it resists corrosion, which can easily occur due to the frequent if not constant exposure to water, particularly salt water in some environments. Various plastics, fiberglass, aluminum, stainless steel, galvanized steel, etc. may be used.

Shown in FIG. 3 is a plan view of the universal cavitation plate assembly 14 of this invention taken along line 3—3 in FIG. 1 which depicts how the three parts fit together around the lower unit 12. Elastomeric insert 18 fits in forward portion 46 of longitudinal slot 36 around the forward-most portions of lower unit 12. Elastomeric insert 18, which is of generally V-shape, is shown in perspective view in FIG. 5, and in cross-sectional view in FIG. 4, which illustrates the outer tongue 48 thereof which is adapted to fit into lateral grooves 38 to keep elastomeric insert 18 in proper relation thereto. As noted, outer tongue 48 should be designed sufficiently wide to always mate to some extent with lateral groove 38 and still cover the distance or extend between ledges 42 and the lower unit 12 to inhibit cavitation, for nearly all lower unit designs.

Generally V-shaped elastomeric insert 18 serves as a buffer or bumper between forward portion 46 of longitudinal slot 36 and lower unit 12. Elastomeric insert 18 helps prevent water from coming up between cavitation plate 16 and lower unit 12, and also helps prevent air from reaching the water surface beneath cavitation plate 16 to help prevent cavitation and turbulence. In this sense, elastomeric insert 18 may be understood as a "seal" between lower unit 12 and cavitation plate 16. Although it would serve the purposes of the invention and be consistent therewith, it is not necessary that elastomeric insert 18 form a perfect air-tight or water-tight seal between cavitation plate 16 and lower unit 12 to serve the purposes of this invention.

Elastomeric insert 18 may be any suitable durable deformable material such as rubber or polyurea plastic or the like. It is designed to conform in shape to the forward portion 46 of the longitudinal slot 36. It is anticipated that only one elastomeric insert 18 is sufficient to service the vast majority of lower unit designs.

While in some embodiments of the invention, it is anticipated that lower unit 12 may occupy substantially all of longitudinal slot 36 when inserted therein, this result is not expected to be the case with most lower units. It is more likely that a considerable portion of longitudinal slot 36 will remain vacant. This condition is undesirable if the goal is to dampen or minimize turbulence since such uncovered longitudinal slot 36 permits the entry of air to the area around the propeller, and permits water to rise or even "rooster tail" through the open area. Thus, it is important to also include a filler piece 50 to occupy the rest of this space and to augment the flat, planar, generally horizontal surfaces 26 and 28 of cavitation plate 16.

Figure 6:
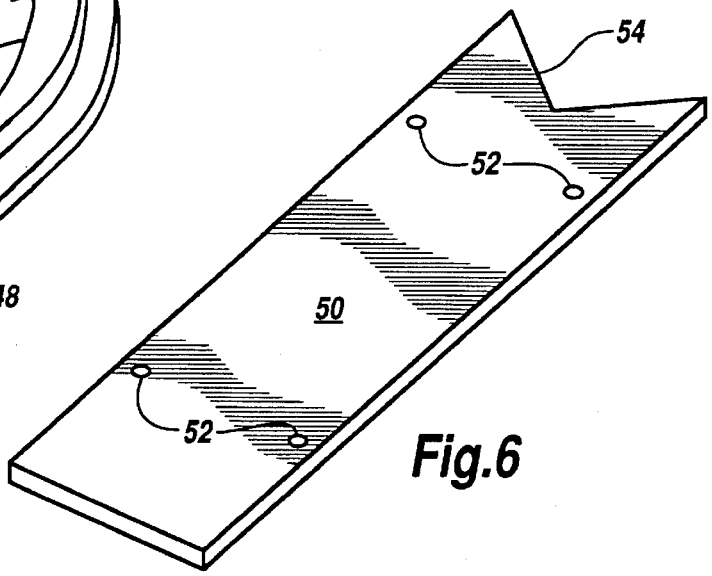
FIG. 6 is a three-quarters, perspective view of the filler piece of the universal cavitation plate assembly of this invention.

Filler piece 50 is more explicitly shown in FIG. 6 and is of simple design. It should have sufficient thinness to permit it to fit into lateral grooves 38 of longitudinal slot 36, if present. It may be secured into place behind integral trim tabs or integral anticavitation plate 40, in various ways using filler piece securing mechanisms 20 shown in FIG. 2. By way of non-limiting example only, such securing mechanism may be holes 52 which are adapted to mate with holes 44, for example, of cavitation plate 16, via plate securing mechanisms such as bolts 20. It will be appreciated, however, that other filler piece 50 securing techniques may be used within the scope of this invention (for example, screws, cotter pins, rivets, adhesives, and the like) and that the invention is not limited by the illustrated use of bolts, since the exact securing mechanism 20 is arbitrary. A securing mechanism 20 also helps keep the universal cavitation plate assembly 14 attached to lower unit 12 on the occasion when the motor 10 is put into reverse and the force keeping lower unit against elastomeric insert 18 and forward portion 46 of longitudinal slot 36 is reversed.

Filler piece 50 is not shown in the FIG. 4 cross-section for the sake of clarity. It may be made of any material that the cavitation plate 16 may be made of. It is anticipated that cavitation plate 16 and filler piece 50 may be made out of the same type of material. In one embodiment of the invention, filler piece 50 has a leading or forward edge 54 with a shape adapted to fit the trailing or rearward edge or shape 56 of lower unit 12 (please see FIG. 3). In FIG. 3, trailing edge 56 of lower unit 12 is flat, and thus leading edge 54 of filler piece 50 is flat to correspond thereto and fill the space. In FIG. 6, the leading edge 54 of filler piece 50 has a contour adapted to mate with a pointed trailing edge 56 profile of lower unit 12. Thus, dealer would stock one filler piece 50 which would be modified easily and quickly on the spot to fit the appropriate lower unit 12 design. In one embodiment of the invention, filler piece 50 might be provided with markings or other indicia (not shown) to indicate where to cut to fit the most prevalent lower unit 12 designs. Alternatively, in another embodiment of the invention, there may be between five to eight sizes of filler pieces 50 sold by the dealer to accommodate all of the various lower unit 12 designs. A certain filler piece 50 might have two different leading edges 54, one on each end of piece 50, whereby the piece 50 could be flipped around to correctly match the contour of the trailing edge 56 of the lower unit 12.

In operation, the consumer buys the one cavitation plate 16 design and one each elastomeric insert 18 and filler plate 50 which are appropriate for the lower unit 12 of his particular boat motor 10. The elastomeric filler is then slid into longitudinal slot 36 of the cavitation plate 16 until it fits against the forward portion 46 thereof. Next, the cavitation plate 16, so equipped, is slid onto the lower unit 12. If present, integral trim tab or integral anticavitation plate 40 mate with lateral grooves 38. No special mechanisms are required to keep lower unit 12 forward against elastomeric insert 16 against the forward portion 46 of longitudinal slot 36. Finally, the filler piece 50 is slid into lateral grooves 38 to fill up the remaining, open portion of longitudinal slot 36, and secured by the plate securing mechanisms 20.

It will be readily seen that the universal cavitation plate assembly and system of this invention permit one "standard" cavitation plate 16 to be used on virtually all boat motor 10 having lower units 12 with the use of a "standard" elastomeric insert 18 and the filler piece 50. No longer will after-market cavitation plates have to be entirely custom made for each boat motor 10 model. Only the filler piece 50 need be adapted for a particular lower unit.

Many modifications may be made in the universal cavitation plate assembly and system of this invention without departing from the spirit and scope thereof which are defined only by the appended claims. For example, it may be discovered that a particular cavitation plate contour functions particularly well at suppressing cavitation and turbulence, or that particular leading edge prow-type designs or side stabilizing fin designs may be particularly advantageous. It is also anticipated that lateral grooves 38 and ledges 42 are not necessary to the functioning of the invention. For example, if lateral groove 38 did not exist, elastomeric insert 28 may have some other feature, e.g. its own groove (not shown), to mate with the cavitation plate 16. Further, it is also not necessary, though it is preferable, that the lower unit 12 has integral trim tabs or integral anticavitation plate 40. One of ordinary skill in the art would be able to readily devise a way of securing the universal cavitation plate assembly 14 on a lower unit 12 in the absence of any or all of these features. All of these possibilities, and others, would be within the scope of the invention.

I claim:

1. A universal cavitation plate assembly comprising:

a cavitation plate having a leading edge, a trailing edge on the opposite side of the cavitation plate from the leading edge, and a longitudinal slot opening in the trailing edge and extending toward the leading edge for part of a length of the cavitation plate, where the slot has a forward portion toward the leading edge, and where the longitudinal slot receives a lower unit of a boat engine, and where the longitudinal slot has at least one ledge;

an elastomeric insert adapted to fit in the longitudinal slot of the cavitation plate at the forward portion between the forward portion and the lower unit, and where the elastomeric insert has a tongue adapted to overlap said at least one ledge; and a filler piece to occupy space remaining in the longitudinal slot between the lower unit and the trailing edge.

2. The universal cavitation plate assembly of claim 1 where the lower unit comprises at least one integral trim tab or at least one integral anticavitation plate and the cavitation plate is secured thereto.

3. The universal cavitation plate assembly of claim 2 where the at least one ledge is adapted to overlap the at least one integral trim tab or at least one integral anticavitation plate.

4. The universal cavitation plate assembly of claim 3 further comprising a lateral groove adjacent the at least one ledge, said lateral groove for mating with the at least one integral trim tab or at least one integral anticavitation plate.

5. The universal cavitation plate assembly of claim 1 where the leading edge of the cavitation plate has a curved, convex contour and further curves upward.

6. The universal cavitation plate assembly of claim 1 where the cavitation plate has left and right sides between the leading and trailing edges, and where the left and right sides have stabilizing fins.

7. A universal cavitation plate assembly comprising:

a cavitation plate having a leading edge having at least one curved contour, a trailing edge on the opposite side of the cavitation plate from the leading edge, and a longitudinal slot opening in the trailing edge and extending toward the leading edge for part of a length of the cavitation plate, where the slot has a forward portion toward the leading edge, and where the longitudinal slot receives a lower unit of a boat engine, and further where the longitudinal slot has at least one ledge for overlapping at least one integral trim tab or at least one integral anticavitation plate on the lower unit;

an elastomeric insert adapted to fit in the longitudinal slot of the cavitation plate at the forward portion between the forward portion and the lower unit, and where the elastomeric insert has a tongue adapted to overlap said at least one ledge; and a filler piece to occupy space remaining in the longitudinal slot between the lower unit and the trailing edge.

8. The universal cavitation plate assembly of claim 7 further comprising a lateral groove adjacent the at least one ledge, said lateral groove for mating with the at least one integral trim tab or at least one integral anticavitation plate.

9. The universal cavitation plate assembly of claim 7 where the lower unit comprises at least one integral trim tab or at least one integral anticavitation plate and the cavitation plate is secured thereto.

10. The universal cavitation plate assembly of claim 7 where the cavitation plate has left and right sides between the leading and trailing edges, and where the left and right sides have stabilizing fins.

11. A universal cavitation plate assembly comprising:

a cavitation plate having a leading edge having at least one curved contour, a trailing edge on the opposite side of the cavitation plate from the leading edge, and a longitudinal slot opening in the trailing edge and extending toward the leading edge for part of a length of the cavitation plate, where the slot has a forward portion toward the leading edge, and where the longitudinal slot receives a lower unit of a boat engine, and further where the longitudinal slot has at least one ledge adjacent a lateral groove, said lateral groove for mating with at least one integral trim tab or at least one integral anticavitation plate on the lower unit;

an elastomeric insert adapted to fit in the longitudinal slot of the cavitation plate at the forward portion between the forward portion and the lower unit, and where the elastomeric insert has a tongue adapted to overlap said at least one ledge; and a filler piece to occupy space remaining in the longitudinal slot between the lower unit and the trailing edge.

12. The universal cavitation plate assembly of claim 11 where the cavitation plate has left and right sides between the leading and trailing edges, and where the left and right sides have stabilizing fins.

* * * * *